US006478510B1

(12) United States Patent
Young

(10) Patent No.: US 6,478,510 B1
(45) Date of Patent: Nov. 12, 2002

(54) DIVE VEST

(76) Inventor: Adam E. Young, 150 Highland Ave., Ithaca, NY (US) 14850

( * ) Notice: Subject to any disclaimer, the term of this patent is extended or adjusted under 35 U.S.C. 154(b) by 0 days.

(21) Appl. No.: 09/840,651

(22) Filed: Apr. 23, 2001

(51) Int. Cl.[7] ..... B63C 11/08; B63C 9/11

(52) U.S. Cl. ..... 405/186; 441/106; 441/111; 441/108; 441/119; 441/118; 441/117; 441/116; 441/115; 441/114; 441/113; 441/112

(58) Field of Search ..... 405/186; 441/106, 441/108, 111, 112, 113, 114, 115, 116, 117, 118, 119; 2/102

(56) References Cited

U.S. PATENT DOCUMENTS

| | | | | | |
|---|---|---|---|---|---|
| 4,990,115 | A | * | 2/1991 | Vorhauer et al. | 441/108 |
| 5,011,334 | A | * | 4/1991 | Vorhauer | 405/186 |
| 5,247,707 | A | * | 9/1993 | Parker et al. | 2/102 |
| 5,346,419 | A | * | 9/1994 | Kaiser | 405/186 |
| 5,378,084 | A | | 1/1995 | Walters et al. | 405/186 |
| 5,451,121 | A | | 9/1995 | Seligman | 405/186 |
| 5,522,679 | A | | 6/1996 | Eungard | 405/186 |
| 5,562,513 | A | * | 10/1996 | Kaiser | 405/186 |
| 5,607,258 | A | | 3/1997 | Eungard | 405/186 |
| 5,662,433 | A | | 9/1997 | Seligman | 405/186 |
| 5,902,073 | A | | 5/1999 | Eungard et al. | 405/187 |

OTHER PUBLICATIONS h.u.b. website www.divedacor.com/hub.html on Nov. 3, 2000.

* cited by examiner

*Primary Examiner*—Heather Shackelford
*Assistant Examiner*—Frederick L. Lagman
(74) *Attorney, Agent, or Firm*—Richard L. Miller

(57) ABSTRACT

A dive vest that includes a torso-engaging member with a waistband, an air bladder contained throughout the torso-engaging member, beaded weight pads quickly releasable from the waistband, a scuba tank carrier plate attached to the torso-engaging member, a first stage regulator with an extended, flexible base that is permanently attached within the dive vest, an on demand/oral inflation assembly extending upwardly from the torso-engaging member, a second stage regulator assembly fluidly communicating with the first stage regulator, and an octopus second stage regulator assembly fluidly communicating with the first stage regulator and being retractable into, and extendable from, the torso-engaging member, and when retracted, is hidden in the torso-engaging member, and as a result thereof, is protected from wear and tear from, and snagging on, objects on both land and underwater and provides less resistance during a dive.

55 Claims, 2 Drawing Sheets

DIVE VEST

BACKGROUND OF THE INVENTION

1. Field of the Invention

The present invention relates to a vest. More particularly, the present invention relates to a dive vest.

2. Description of the Prior Art

Numerous innovations for utility vests have been provided in the prior art that will be described. Even though these innovations may be suitable for the specific individual purposes to which they address, however, they differ from the present invention.

A FIRST EXAMPLE, U.S. Pat. No. 5,378,084 to Walters et al. teaches a scuba pack that enables a user to carry a substantial back supported load with comfort and mobility. The pack has a flexible load container having a base panel for engagement on the back of a user, wherein the base panel having extensions fitting over each shoulder and around a portion of the waist of the user. The pack also has a harness disposed on the front of the user, which adjustably interconnects the extensions of the flexible load container across the front waist of the user. The harness also adjustably interconnects the shoulder extensions to the waist extensions. The harness is longitudinally flexible within a selected range, such that load forces are transmitted to the waist region while holding the load in conformity to the user without restricting body movement.

A SECOND EXAMPLE, U.S. Pat. No. 5,451,121 to Seligman teaches a combination unit of a buoyancy compensator, backpack, and spider having adjustable combination strap means forming a combination shoulder strap and belt strap means with releasable strap retaining means. A backpack for support of a gas cylinder is attached to the back of the spider. The buoyancy compensator overlies the spider and has two downward extending lobes, each having a bottom and sides that are configured to surround the backpack without interfering with the attachment of a pressurized gas cylinder. The buoyancy compensator includes independent suspension means whereby it is attached to the spider at the shoulder and neckline areas and tacked to the spider at the bottom of each downward lobe portion of the buoyancy compensator. Two buoyancy compensator strap means are attached to the spider and to the sides of each downward lobe of said buoyancy compensator and are restrained by an elastic tether attached to the spider to permit expansion of the buoyancy compensator away from a diver's body during inflation.

A THIRD EXAMPLE, U.S. Pat. No. 5,522,679 to Eungard teaches a buoyancy compensator assembly for a diver that is provided with a vest having an inner gas impermeable layer adapted to face a wearer and a congruently shaped opposing gas impermeable outer layer. The peripheral edges of the inner and outer layers are sealingly bonded to each other. The vest has an opening through a back portion of the vest. A backpack for removably retaining a longitudinally extending breathing gas tank has a baseplate generally disposed within the opening. Attached to the periphery of the baseplate is an edge. The edge is disposed between and integrally bonded to the inner and outer layers whereby the layers form a chamber to be selectively inflated to adjust the buoyancy of the diver. A restraining sheet is located between and alternately attached to the inner layer and outer layer to form aligned bands. The sheet forces the inner layer to curve inward about the sides of the diver when the chamber is inflated. The backpack is constructed so that when the breathing gas tank is strapped onto the backpack the baseplate curves to fit about the back of the diver.

A FOURTH EXAMPLE, U.S. Pat. No. 5,607,258 to Eungard teaches a harness for use in scuba diving. The harness is independent of the air cell and includes arcuate shoulder straps to promote the comfort of the scuba diver, particularly when moving about above water with the air tanks and other scuba equipment in place. The harness also has an affixed webbing system to where a rigid backpack may be adjustably mounted.

A FIFTH EXAMPLE, U.S. Pat. No. 5,662,433 to Seligman teaches a combination spider and buoyancy compensator having chest portions which include stretchable material to support the breasts of a diver. The buoyancy compensator is secured to the back of a spider and has forward extensions which overlap and are loosely tethered to waistband portions of the spider. The waistband portions of the spider are secured to the back portion of the spider by adjustable means for waist size adjustment.

A SIXTH EXAMPLE, U.S. Pat. No. 5,902,073 to Eungard et al. teaches a support garment for diving equipment that includes several subassemblies for providing comfortable support of diving equipment, such as a tank of pressurized breathing gas, a buoyancy compensating air cell and a ballast weight pocket assembly. A frame is adjustably secured to a shoulder support assembly that includes adjustment straps for accommodating various body sizes. A belt assembly is pivotally secured to the lower portion of the frame. A bust or chest panel extends between shoulder supports, providing a secure and comfortable fitting structure for divers of various body types, particularly women. Elements of the garment are secured to one another via rivets placed at predetermined locations, thereby facilitating assembly and servicing of the garment.

It is apparent that numerous innovations for utility vests have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a dive vest that avoids the disadvantages of the prior art.

ANOTHER OBJECT of the present invention is to provide a dive vest that is simple and inexpensive to manufacture.

STILL ANOTHER OBJECT of the present invention is to provide a dive vest that is simple to use.

BRIEFLY STATED, STILL YET ANOTHER OBJECT of the present invention is to provide a dive vest that includes a torso-engaging member with a waistband, an air bladder contained throughout the torso-engaging member, beaded weight pads quickly releasable from the waistband, a scuba tank carrier plate attached to the torso-engaging member, a first stage regulator permanently attached to the scuba tank carrier plate, an on demand/oral inflation assembly extending upwardly from the torso-engaging member, a second stage regulator assembly fluidly communicating with the first stage regulator, and an octopus second stage regulator assembly fluidly communicating with the first stage regulator and being retractable into, and extendable from, the torso-engaging member, and when retracted, is hidden in the torso-engaging member, and as a result thereof, is protected from wear and tear from, and snagging on, objects on both land and underwater and provides less resistance during a dive.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

10 dive vest of present invention

12 torso-engaging member

Figure 2:
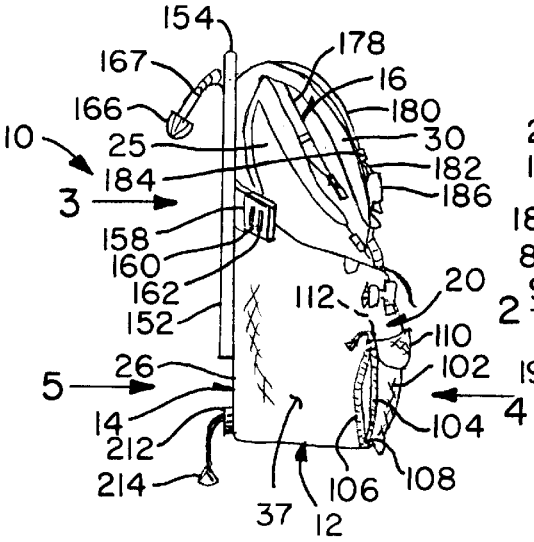
FIG. 2 is a diagrammatic side elevational view taken generally in the direction of arrow 2 in FIG. 1.

14 back-engaging portion of torso-engaging member 12

16 right shoulder-engaging portion of torso-engaging member 12

18 left shoulder-engaging portion of torso-engaging member 12

20 right abdomen-engaging portion of torso-engaging member 12

22 left abdomen-engaging portion of torso-engaging member 12

23 neck-receiving space defined by right shoulder-engaging portion 16 of torso-engaging member 12 and left shoulder-engaging portion 18 of torso-engaging member 12 when dive vest 10 is donned

24 back-facing surface of back-engaging portion 14 of torso-engaging member 12

25 right arm-receiving space defined by right shoulder-engaging portion 16 of torso-engaging member 12 and right abdomen-engaging portion 20 of torso-engaging member 12 when dive vest 10 is donned

26 ambient-facing surface of back-engaging portion 14 of torso-engaging member 12

27 left arm-receiving space defined by left shoulder-engaging portion 18 of torso-engaging member 12 and left abdomen-engaging portion 22 of torso-engaging member 12 when dive vest 10 is donned

28 shoulder-facing surface of right shoulder-engaging portion 16 of torso-engaging member 12

30 ambient-facing surface of right shoulder-engaging portion 16 of torso-engaging member 12

32 shoulder-facing surface of left shoulder-engaging portion 18 of torso-engaging member 12

33 buffer layer contained in torso-engaging member 12 and capturing and protecting selectively-inflatable air bladder 36

34 ambient-facing surface of left shoulder-engaging portion 18 of torso-engaging member 12

35 abdomen-facing surface of right abdomen-engaging portion 20 of torso-engaging member 12

36 selectively-inflatable air bladder of torso-engaging member 12 contained in, and extending throughout, back-engaging portion 14 of torso-engaging member 12, right shoulder-engaging portion 16 of torso-engaging member 12, left shoulder-engaging portion 18 of torso-engaging member 12, right abdomen-engaging portion 20 of torso-engaging member 12, and left abdomen-engaging portion 22 of torso-engaging member 12

37 ambient-facing surface of right abdomen-engaging portion 20 of torso-engaging member 12

38 right shoulder padding extending along majority of shoulder-facing surface 28 of right shoulder-engaging portion 16 of torso-engaging member 12 for providing comfort for right shoulder (not shown) of diver (not shown) when dive vest 10 is donned

39 abdomen-facing surface of left abdomen-engaging portion 22 of torso-engaging member 12

40 left shoulder padding extending along majority of shoulder-facing surface 32 of left shoulder-engaging portion 18 of torso-engaging member 12 for providing comfort for left shoulder (not shown) of diver (not shown) when dive vest 10 is donned

41 ambient-facing surface of left abdomen-engaging portion 22 of torso-engaging member 12

42 back padding extending along a majority of back-facing surface 24 of back-engaging portion 12 of torso-engaging member 12 for providing comfort for back (not shown) of diver (not shown) when dive vest 10 is donned

44 right waist band-retaining band extending vertically across intermediate portion of abdomen-facing surface 35 of right abdomen-engaging portion 20 of torso-engaging member 12

46 left waist band-retaining band extending vertically across intermediate portion of abdomen-facing surface 39 of left abdomen-engaging portion 22 of torso-engaging member 12

48 first intermediate waist band-retaining band 48 extending vertically across a lower portion of back-facing surface 24 of back-engaging portion 14 of torso-engaging member 12

50 second intermediate waist band-retaining band extending vertically across a lower portion of back-facing surface 24 of back-engaging portion 14 of torso-engaging member 12

52 adjustable waist band of torso-engaging member 12

54 right terminal end of adjustable waist band 52 of torso-engaging member 12

56 left terminal end of adjustable waist band 52 of torso-engaging member 12

58 torso-facing surface of adjustable waist band 52 of torso-engaging member 12

60 ambient-facing surface of adjustable waist band 52 of torso-engaging member 12

62 waist band patch of hook portions of hook and loop fasteners of adjustable waist band 52 of torso-engaging member 12

64 waist band patch of loop portions of hook and loop fasteners of adjustable waist band 52 of torso-engaging member 12
66 left waist adjustment strap of torso-engaging member 12
68 terminal end of left waist adjustment strap 66 of torso-engaging member 12
70 left waist male portion of quick disconnect buckle of torso-engaging member 12
72 right waist adjustment strap of torso-engaging member 12
74 terminal end of right waist adjustment strap 72 of torso-engaging member 12
76 right waist female portion of quick disconnect buckle of torso-engaging member 12
78 left shoulder adjustment strap of torso-engaging member 12
80 terminal end of left shoulder adjustment strap 78 of torso-engaging member 12
82 left shoulder female portion of quick disconnect buckle of torso-engaging member 12
84 right shoulder adjustment strap of torso-engaging member 12
86 terminal end of right shoulder adjustment strap 84 of torso-engaging member 12
88 right shoulder male portion of quick disconnect buckle of torso-engaging member 12
90 left abdomen adjustment strap of torso-engaging member 12
92 terminal end of left abdomen adjustment strap,90 of torso-engaging member 12
94 left abdomen male portion of quick disconnect buckle of torso-engaging member 12
96 right abdomen adjustment strap of torso-engaging member 12
98 terminal end of right abdomen adjustment strap 96 of torso-engaging member 12
100 right abdomen male portion of quick disconnect buckle of torso-engaging member 12
102 two-way right abdomen pocket of torso-engaging member 12
104 first pocket of two-way right abdomen pocket 102 of torso-engaging member 12
106 right side opening in first pocket 104 of two-way right abdomen pocket 102 of torso-engaging member 12
108 right zipper selectively closing right side opening 106 in first pocket 104 of two-way right abdomen pocket 102 of torso-engaging member 12
110 second pocket of two-way right abdomen pocket 102 of torso-engaging member 12
112 right top opening in second pocket 110 of two-way right abdomen pocket 102 of torso-engaging member 12
114 flap selectively closing right top opening 112 in second pocket 110 of two-way right abdomen pocket 102 of torso-engaging member 12
115 mating portions of flap hook and loop fasteners
116 left abdomen pocket of torso-engaging member 12
118 left side opening in left abdomen pocket 116 of torso-engaging member 12
120 left zipper selectively closing left side opening 118 in left abdomen pocket 116 of torso-engaging member 12
122 ambient-facing surface of left abdomen pocket 116 of torso-engaging member 12
124 dive knife sheath
126 dive knife
128 gauge console
130 swivel joint of gauge console 128
132 pair of right abdomen utility D-rings
134 pair of left abdomen utility D-rings
136 left beaded weight pad
138 left waist band compartment contained in adjustable waist band 52 of torso-engaging member 12
140 left quick release pull cord operatively depending from left waist band compartment 138 contained in adjustable waist band 52 of torso-engaging member 12
142 right beaded weight pad
144 right waist band compartment contained in adjustable waist band 52 of torso-engaging member 12
146 right quick release pull cord operatively depending from right waist band compartment 144 contained in adjustable waist band 52 of torso-engaging member 12
148 right shoulder utility D-ring
150 left shoulder utility D-ring
152 scuba tank carrier plate
154 carry handle of scuba tank carrier plate 152
156 first tank holding strap
157 ambient-facing surface of first tank holding strap 156
158 second tank holding strap
160 terminal end of second tank holding strap 158
162 tank holding clasp
164 mating portions of tank strap hook and loop fasteners
166 first stage regulator for fluidly communicating with scuba tank (not shown)
167 extended, flexible base of first stage regulator 166 that is permanently affixed to dive vest 10 for facilitating attachment to valve (not shown) of scuba tank (not shown)
168 internal low pressure gauge hose
170 plurality of gauge hose retaining straps
172 on demand/oral inflation assembly
174 internal low pressure inflation hose of on demand/oral inflation assembly 172
176 external low pressure inflation hose of on demand/oral inflation assembly 172
177 hose snaps of on demand/oral inflation assembly 172
178 second stage regulator assembly
180 low pressure regulator hose of second stage regulator assembly 178
182 distal end of low pressure regulator hose 180 of second stage regulator assembly 178
184 regulator hose clasp of second stage regulator assembly 178 for requiring only one hand (not shown) of diver (not shown) to release
186 second stage regulator of second stage regulator assembly 178
188 octopus second stage regulator assembly
190 octopus low pressure regulator hose of octopus second stage regulator assembly 188
192 distal end of octopus low pressure regulator hose 190 of octopus second stage regulator assembly 188
194 octopus regulator hose clasp of octopus second stage regulator assembly 188 for requiring only one hand (not shown) of diver (not shown) to release
196 pair of hose retaining straps of octopus second stage regulator assembly 188
198 upper slide collar of octopus second stage regulator assembly 188
200 upper elastic cord of octopus second stage regulator assembly 188
202 upper anchor point of octopus second stage regulator assembly 188
204 lower slide collar of octopus second stage regulator assembly 188
206 lower elastic cord of octopus second stage regulator assembly 188

208 lower anchor point of octopus second stage regulator assembly 188
210 octopus second stage regulator of octopus second stage regulator assembly 188
212 air release valve
214 release valve pull cord
216 proximal end of external low pressure inflation hose 176 of on demand/oral inflation assembly 172
218 distal end of external low pressure inflation hose 176 of on demand/oral inflation assembly 172
220 auto inflate button of on demand/oral inflation assembly 172 for allowing scuba tank (not shown) to automatically inflate selectively-inflatable air bladder 36
222 mouthpiece of on demand/oral inflation assembly 172
224 spring loaded oral inflate button of on demand/oral inflation assembly 172
226 air release valve of on demand/oral inflation assembly 172
228 pull cable of on demand/oral inflation assembly 172
230 upper terminal end of pull cable 228 of on demand/oral inflation assembly 172
232 anchor point of on demand/oral inflation assembly 172
234 lower terminal end of pull cable 228 of on demand/oral inflation assembly 172
236 body of each of regulator hose clasp 184 and octopus regulator hose clasp 194
238 base of body 236
239 free end of base 238 of body 236
240 spine of body 236
242 head of body 236
243 free end of head 242 of body 236
244 inner facing surfaces of base 238 of body 236 and head 242 of body 236
246 inner surface of spine 240 of body 236
248 first opening defined by inner surface 246 of spine 240 of body
236 together with innermost portions of inner surfaces 244 of base
238 of body 236 and head 242 of body 236
250 second opening defined by outermost portions of inner surfaces 244 of base 238 of body 236 and head 242 of body 236 for communicating with ambient so as to provide weaker capture than that of first opening 248 defined by outermost portions of inner surfaces 244 of base 238 of body-236 and head 242 of body 236, if a not so secure capture is required, just as one that is only temporary.

DETAILED DESCRIPTION OF THE PREFERRED EMBODIMENT

Figure 1:
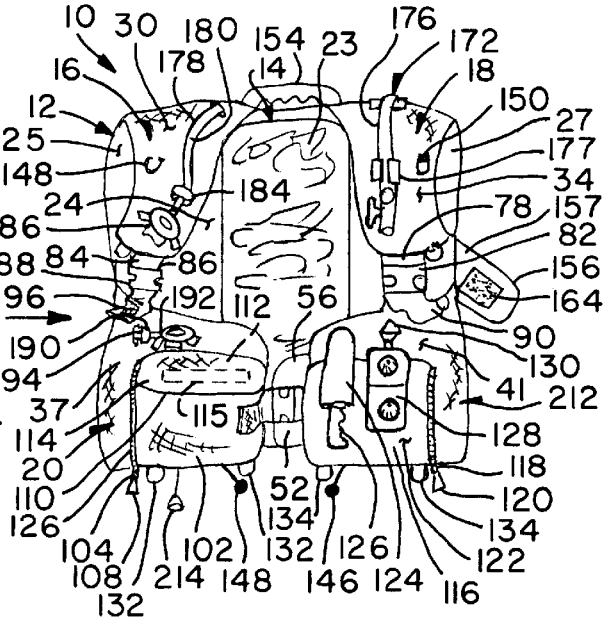
FIG. 1 is a diagrammatic front elevational view of the present invention in the donned configuration.
Figure 3:
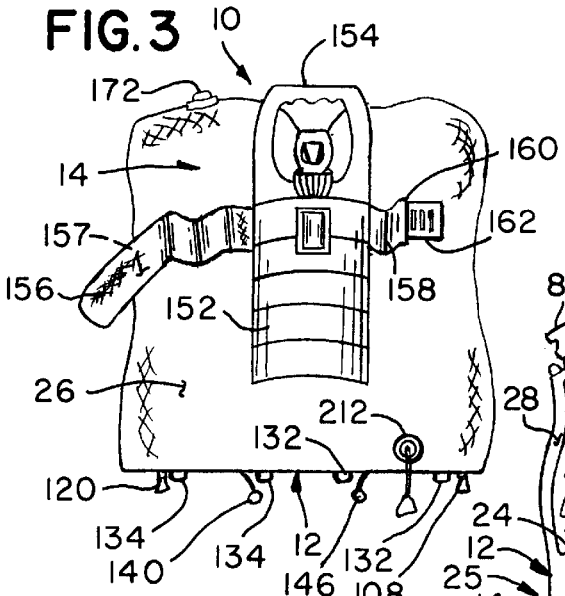
FIG. 3 is a diagrammatic rear elevational view taken generally in the direction of arrow 3 in FIG. 2.
Figure 4:
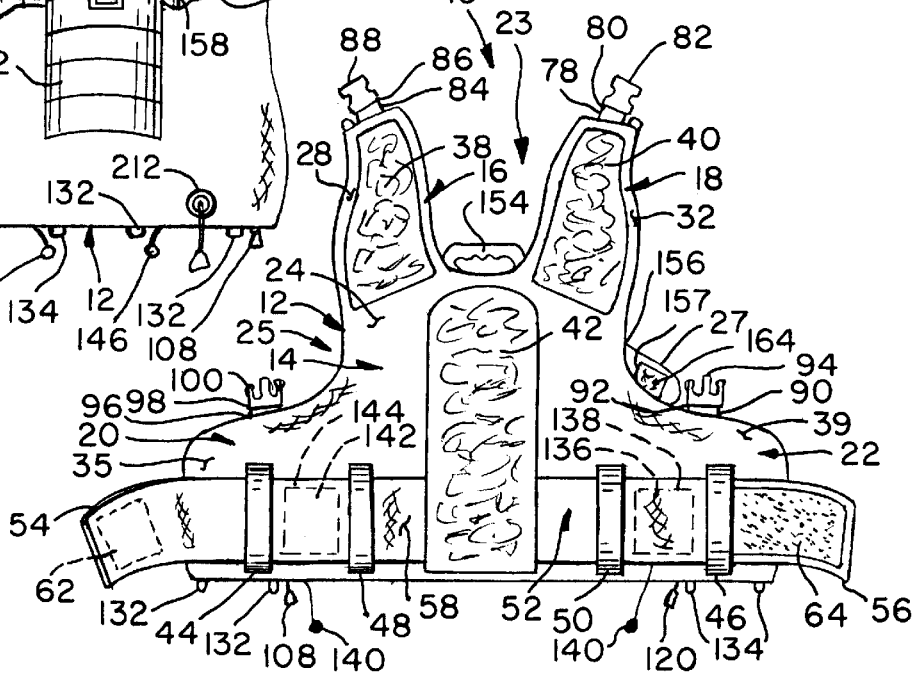
FIG. 4 is a diagrammatic front elevational view taken generally in the direction of arrow 4 in FIG. 2 of the present invention in the pre-donned configuration.

Referring now to the figures, in which like numerals indicate like parts, and particularly to FIG. 1, the dive vest of the present invention is shown generally at 10 for holding a scuba tank (not shown) with a valve (not shown).

The overall configuration of the dive vest 10 can best be seen in FIGS. 1–5, and as such, will be discussed with reference thereto.

The dive vest 10 comprises a torso-engaging member 12 that comprises a back-engaging portion 14, a right shoulder-engaging portion 16 that extends upwardly and outwardly from the back-engaging portion 14 prior to donning the dive vests 10 and forwardly then downwardly after donning the dive vest 10, a left shoulder-engaging portion 18 that extends upwardly and outwardly from the back-engaging portion 14 prior to donning the dive vest 10 and forwardly then downwardly after donning the dive vest 10, a right abdomen-engaging portion 20 that extends sidewardly and outwardly from the back-engaging portion 14 prior to donning the dive vest 10 and forwardly then inwardly after donning the dive vest 10, and a left abdomen-engaging portion 22 that extends sidewardly from the back-engaging portion 14 prior to donning the dive vest 10 and forwardly then inwardly after donning the dive vest 10.

The right shoulder-engaging portion 16 and the left shoulder-engaging portion 18 define therebetween a neck-receiving space 23 when the dive vest 10 is donned.

The right shoulder-engaging portion 16 and the right abdomen-engaging portion 20 define therebetween a right arm-receiving space 25 when the dive vest 10 is donned.

The left shoulder-engaging portion 18 and the left abdomen-engaging portion 22 define therebetween a left arm-receiving space 27 when the dive vest 10 is donned.

The back-engaging portion 14 has a back-facing surface 24 and an ambient-facing surface 26 that is opposite to the back-facing surface 24 thereof.

The right shoulder-engaging portion 16 has a shoulder-facing surface 28 that is continuous with the back-facing surface 24 of the back-engaging portion 14 and an ambient-facing surface 30 that is opposite to the shoulder-facing surface 28 thereof and is continuous with the ambient-facing surface 26 of the back-engaging portion 14.

The left shoulder-engaging portion 18 has a shoulder-facing surface that is continuous with the back-facing surface 24 of the back-engaging portion 14 and an ambient-facing surface 34 that is opposite to the shoulder-facing surface 32 thereof and is continuous with the ambient-facing surface 26 of the back-engaging portion 14.

The right abdomen-engaging portion 20 has an abdomen-facing surface 35 that is continuous with the back-facing surface 24 of the back-engaging portion 14 and an ambient-facing surface 37 that is opposite to the abdomen-facing surface 35 thereof and is continuous with the ambient, facing surface 26 of the back-engaging portion 14.

The left abdomen-engaging portion 22 has an abdomen-facing surface 39 that is continuous with the back-facing surface 24 of the back-engaging portion 14 and an ambient-facing surface 41 that is opposite to the abdomen-facing surface 39 thereof and is continuous with the ambient-facing surface 26 of the back-engaging portion 14.

The torso-engaging member 12 further comprises a selectively-inflatable air bladder 36 that is contained in, and extends throughout, the back-engaging portion 14 thereof, the right shoulder-engaging portion 16 thereof, the left shoulder-engaging portion 18 thereof, the right abdomen-engaging portion 20 thereof, and the left abdomen-engaging portion 22 thereof so as to provide full flotation, and not just back mounted flotation, and when inflated, renders the torso-engaging member 12 buoyant.

The torso-engaging member 12 further comprises a buffer layer 33 that is contained thereon and captures and protects the selectively-inflatable air bladder 36.

The right shoulder-engaging portion 16 further has right shoulder padding 38 that extends along a majority of the shoulder-facing surface 28 thereof for providing comfort for the right shoulder (not shown) of a diver (not shown) when the dive vest 10 is donned.

The left shoulder-engaging portion 18 further has left shoulder padding 40 that extends along a majority of the shoulder-facing surface 32 thereof for providing comfort for the left shoulder (not shown) of a diver (not shown) when the dive vest 10 is donned.

The back-engaging portion 12 further has back padding 42 that extends along a majority of the back-facing surface 24 thereof for providing comfort for the back (not shown) of a diver (not shown) when the dive vest 10 is donned.

The right abdomen-engaging portion 20 further has a right waist band-retaining band 44 that extends vertically across an intermediate portion of the abdomen-facing surface 35 thereof.

The left abdomen-engaging portion 22 further has a left waist band-retaining band 46 that extends vertically across an intermediate portion of the abdomen-facing surface 39 thereof, and is in alignment with the right waist band-retaining band 44.

The back-engaging portion 14 further has a first intermediate waist band-retaining band 48 that extends vertically across a lower portion of the back-facing surface 24 thereof, intermediate the back padding 42 and, and in alignment with, the right waist band-retaining band 44.

The back-engaging portion 14 further has a second intermediate waist band-retaining band 50 that extends vertically across a lower portion of the back-facing surface 24 thereof, intermediate the back padding 42 and, and in alignment with, the left waist band-retaining band 46.

The torso-engaging member 12 further comprises an adjustable waist band 52 that is slender, elongated, and extends under, and is retained by, the right waist band-retaining band 44, the first intermediate waist band-retaining band 48, the back padding 42, the second intermediate waist band-retaining band 50, and the left waist band-retaining band 46.

The adjustable waist band 52 has a right terminal end 54 that extends outwardly past the right abdomen-engaging portion 20, a left terminal end 56 that extends past the left abdomen-engaging portion 22, a torso-facing surface 58, and an ambient-facing surface 60.

The adjustable waist band 52 further has a waist band patch of hook portions of hook and loop fasteners 62 that is disposed at the right terminal end 54 thereof, on the ambient-facing surface 60 thereof.

The adjustable waist band 52 further has a waist band patch of loop portions of hook and loop fasteners 64 that is disposed at the left terminal end 56 thereof, on the torso-facing surface 58 thereof, and selectively engages with the waist band patch of hook portions of hook and loop fasteners 62.

The torso-engaging member 12 further comprises a left waist adjustment strap 66 that extends slightly sidewardly from the left abdomen-engaging portion 22, to a terminal end 68.

The torso-engaging member 12 further comprises a left waist male portion of a quick disconnect buckle 70 that extends axially from the terminal end 68 of the left waist adjustment strap 66, and overlies a minority of the left terminal end 56 of the adjustable waist band 52, on, so as to be cushioned by, the ambient-facing surface 60 thereof for providing comfort for the waist (not shown) of a diver (not shown) when the dive vest 10 is donned.

The torso-engaging member 12 further comprises a right waist adjustment strap 72 that extends slightly sidewardly from the right abdomen-engaging portion 20, to a terminal end 74.

The torso-engaging member 12 further comprises a right waist female portion of a quick disconnect buckle 76 that selectively engages with the left waist male portion of a quick disconnect buckle 70, and extends axially from the terminal end 74 of the right waist adjustment strap 72, and overlies a minority of the right terminal end 54 of the adjustable waist band 52, on, so as to be cushioned by, the ambient-facing surface 60 thereof for providing comfort for the waist (not shown) of a diver (not shown) when the dive vest 10 is donned.

The torso-engaging member 12 further comprises a left shoulder adjustment strap 78 that extends slightly upwardly from the left shoulder-engaging portion 18, to a terminal end 80.

The torso-engaging member 12 further comprises a left shoulder female portion of a quick disconnect buckle 82 that extends axially from the terminal end 80 of the left shoulder adjustment strap 78.

The torso-engaging member 12 further comprises a right shoulder adjustment strap 84 that extends slightly upwardly from the right shoulder-engaging portion 16, to a terminal end 86.

The torso-engaging member 12 further comprises a right shoulder male portion of a quick disconnect buckle 88 that extends axially from the terminal end 86 of the right shoulder adjustment strap 84.

The torso-engaging member 12 further comprises a left abdomen adjustment strap 90 that extends slightly upwardly from the left abdomen-engaging portion 22, to a terminal end 92.

The torso-engaging member 12 further comprises a left abdomen male portion of a quick disconnect buckle 94 that extends axially from the terminal end 92 of the left abdomen adjustment strap 90, and selectively engages with the left shoulder female portion of a quick disconnect buckle 82, and when engaged therewith, forms the left arm-receiving space 27.

The torso-engaging member 12 further comprises a right abdomen adjustment strap 96 that extends slightly upwardly from the right abdomen-engaging portion 20, to a terminal end 98.

The torso-engaging member 12 further comprises a right abdomen male portion of a quick disconnect buckle 100 that extends axially from the terminal end 98 of the right abdomen adjustment strap 96, and selectively engages with the right shoulder female portion of a quick disconnect buckle 88, and when engaged therewith, forms the right arm-receiving space 25.

The torso-engaging member 12 further comprises a two-way right abdomen pocket 102 that is disposed on a forwardmost portion of the ambient-facing surface 37 of the right abdomen-engaging portion 20.

The two-way right abdomen pocket 102 comprises a first pocket 104 that is accessible through a right side opening 106 that is selectively closed by a right zipper 108.

The two-way right abdomen pocket 102 further comprises a second pocket 110 that overlies the first pocket 104 and is accessible through a right top opening 112 that is selectively closed by a flap 114 which is selectively maintained closed by mating portions of flap hook and loop fasteners 115.

The torso-engaging member 12 further comprises a left abdomen pocket 116 that is disposed on a forwardmost portion of the ambient-facing surface 41 of the left abdomen-engaging portion 22, and is accessible through a left side opening 118 that is selectively closed by a left zipper 120, and has an ambient-facing surface 122.

The dive vest 10 further comprises a dive knife sheath 124 that is attached to the ambient-facing surface 122 of the left abdomen pocket 116, and opens downwardly.

The dive vest 10 further comprises a dive knife 126 that is replaceably disposed in the dive knife sheath 124.

The dive vest 10 further comprises a gauge console 128 that is swively attached, by a swivel joint 130, to the ambient-facing surface 41 of the left abdomen-engaging portion 22, and depends therefrom to over the ambient-facing surface 122 of the left abdomen pocket 116, between the dive knife sheath 124 and the left zipper 120, as opposed to being stuffed into a zippered pocket making critical access difficult.

The dive vest 10 further comprises a pair of right abdomen utility D-rings 132 that depend spacingly from a forwardmost portion of the right abdomen-engaging portion 20, directly below the two-way right abdomen pocket 102.

The dive vest 10 further comprises a pair of left abdomen utility D-rings 134 that depend spacingly from a forwardmost portion of the left abdomen-engaging portion 22, directly below the left abdomen pocket 116.

The dive vest 10 further comprises a left beaded weight pad 136 that is disposed in a left waist band compartment 138 that is contained in the adjustable waist band 52, and is disposed between the second intermediate waist band-retaining band 50 and the left waist band-retaining band 46.

The left beaded weight pad 136 is quick releasable from the left waist band compartment 138 by a left quick release pull cord 140 that operatively depends from the left waist band compartment 138.

The dive vest 10 further comprises a right beaded weight pad 142 that is disposed in a right waist band compartment 144 that is contained in the adjustable waist band 52, and is disposed between the right waist band-retaining band 44 and the first intermediate waist band-retaining band 48.

The right beaded weight pad 142 is quick releasable from the right waist band compartment 144 by a right quick release pull cord 146 that operatively depends from the right waist band compartment 144.

The dive vest 10 further comprises a right shoulder utility D-ring 148 that is disposed on a forwardmost portion of the ambient-facing surface 30 of the right shoulder-engaging portion 16, slightly inwardly of the right arm-receiving space 25.

The dive vest 10 further comprises a left shoulder utility D-ring 150 that is disposed on a forwardmost portion of the ambient-facing surface 32 of the left shoulder-engaging portion 18, slightly inwardly of the left arm-receiving space 27.

The dive vest 10 further comprises a scuba tank carrier plate 152 that extends vertically along the ambient-facing surface 26 of the back-engaging portion 14, and into the neck-receiving space 23, where it is formed into a carry handle 154.

The scuba tank carrier plate 152 is made of molded hard plastic that is shaped for holding the scuba tank (not shown).

The dive vest 10 further comprises a first tank holding strap 156 that is slender, elongated, extends sideways outwardly from one side of the scuba tank carrier plate 152, along an intermediate point therealong, and has an ambient-facing surface 157.

The dive vest 1*e* further comprises a second tank holding strap 158 that is slender, elongated, and extends sideways outwardly from the other side of the scuba tank carrier plate 152, along an intermediate point therealong, to a terminal end 160.

The dive vest 10 further comprises a tank holding clasp 162 that extends axially from the terminal end 160 of the second tank holding strap 158, and selectively engages the first tank holding strap 156, and when engaged therewith, captures and holds the scuba tank (not shown) against he scuba tank carrier plate 152.

The dive vest 10 further comprises mating portions of tank strap hook and loop fasteners 164 that are spaced along the ambient-facing surface 157 of the first tank holding strap 156, and when the first tank holding strap 156 engages the tank holding clasp 162 and captures and holds the scuba tank (not shown) against the scuba tank carrier plate 152, the first tank holding strap 156 is doubled back onto itself and maintained thereat by engagement of the mating portions of tank strap hook and loop fasteners 164 with each other so as to prevent the first tank holding strap 156 from dangling obtrusively and becoming damaged during a dive.

The dive vest 10 further comprises a first stage regulator 166 that is permanently attached thereto, is supported by the scuba tank carrier plate 152, is disposed in proximity of the carry handle 154, and is for fluidly communicating with the scuba tank (not shown).

The first stage regulator 166 has a base 167 that is extended and flexible for facilitating attachment to the valve (not shown) of the scuba tank (not shown).

The dive vest 10 further comprises an internal low pressure gauge hose 168 that fluidly communicates the first stage regulator 166 with the gauge console 128.

The internal low pressure gauge hose 168 depends from the first stage regulator 166, through the ambient-facing surface 26 of, and into, the back-engaging portion 14 and then through the left abdomen-engaging portion 22 so as to be permanently hidden within the torso-engaging member 12, and as a result thereof, is protected from wear and tear from, and snagging on, objects on both land and underwater and provides less resistance during a dive, as opposed to having to be manually stuffed into, and removed from, a pocket, and then out the ambient-facing surface 41 of the left abdomen-engaging portion 22, at, and to, the gauge console 128.

The internal low pressure gauge hose 168 is fixedly maintained in the back-engaging portion 14 and the left abdomen-engaging portion 22 by a plurality of gauge hose retaining straps 170 that are disposed therein.

The dive vest 10 further comprises an on demand/oral inflation assembly 172 that fluidly communicates with the first stage regulator 166 and the selectively-inflatable air bladder 36, and extends upwardly therefrom in the back-engaging portion 14 and the left shoulder-engaging portion 18, and out through the ambient-facing surface 34 of the left shoulder-engaging portion 18 for exiting the left shoulder-engaging portion 18 as close as possible to the mouth (not shown) of the diver (not shown), as opposed to having to be manually stuffed into, and removed from, a pocket, and when removed exiting and extending upwardly along the torso (not shown) of the diver (not shown) and becoming damaged from wear and tear from, and snagging on, objects on both land and underwater while also providing resistance during a dive.

The on demand/oral inflation assembly 172 comprises an internal low pressure inflation hose 174 that fluidly communicates with the first stage regulator 166, selectively fluidly communicates with the selectively-inflatable air bladder 36, and extends sidewardly outwardly upwardly from the first stage regulator 166 in the back-engaging portion 14 and then upwardly in the left shoulder-engaging portion 18, to, and through, the ambient-facing surface 34 of the left shoulder-engaging portion 18.

The internal low pressure inflation hose 174 is maintained in the back-engaging portion 14 and the left shoulder-engaging portion 18 by sharing an uppermost strap of the plurality of gauge hose retaining straps 170.

The on demand/oral inflation assembly 172 further comprises an external low pressure inflation hose 176 that fluidly communicates with the selectively-inflatable air bladder 36, selectively fluidly communicates with the internal low pressure inflation hose 174 that extends concentrically therein, and extends outwardly from the ambient-facing surface 34 of, and extends along, but not past so as to be protected by when not in use, the left shoulder-engaging portion 18.

The external low pressure inflation hose 176 is selectively maintained against the ambient-facing surface 34 of the left shoulder-engaging portion 18 by hose snaps 177 so as to prevent the external low pressure inflation hose 176 from dangling obtrusively and becoming damaged when not in use during a dive.

The dive vest 10 further comprises a second stage regulator assembly 178 that fluidly communicates with the first stage regulator 166.

The second stage regulator assembly 178 comprises a low pressure regulator hose 180 that fluidly communicates with the first stage regulator 166, and extends sidewardly outwardly upwardly therefrom in the back-engaging portion 14 and then upwardly in the right shoulder-engaging portion 16, through the ambient-facing surface 30 of, and along, but not past so as to be protected by when not in use, the right shoulder-engaging portion 16, to a distal end 182 for exiting the right shoulder-engaging portion 16 as close as possible to the mouth (not shown) of the diver (not shown), as opposed to exiting and extending upwardly along the torso (not shown) of the diver (not shown) and becoming damaged from wear and tear from, and snagging on, objects on both land and underwater while also providing resistance during a dive.

The low pressure regulator hose 180 is selectively maintained against the ambient-facing surface 30 of the right shoulder-engaging portion 16 by a regulator hose clasp 184 for requiring only one hand (not shown) of diver (not shown) to release and engage, extends from the ambient-facing surface 30 of the right shoulder-engaging portion 16, and prevents the low pressure regulator hose 180 from dangling obtrusively and becoming damaged when not in use during a dive.

The regulator hose clasp 184 is molded from hard plastic.

The second stage regulator assembly 178 further comprises a second stage regulator 186 that fluidly communicates with the distal end 182 of the low pressure regulator hose 180 thereof.

The dive vest 10 further comprises an octopus second stage regulator assembly 188 that fluidly communicates with the first regulator 166.

Figure 5:
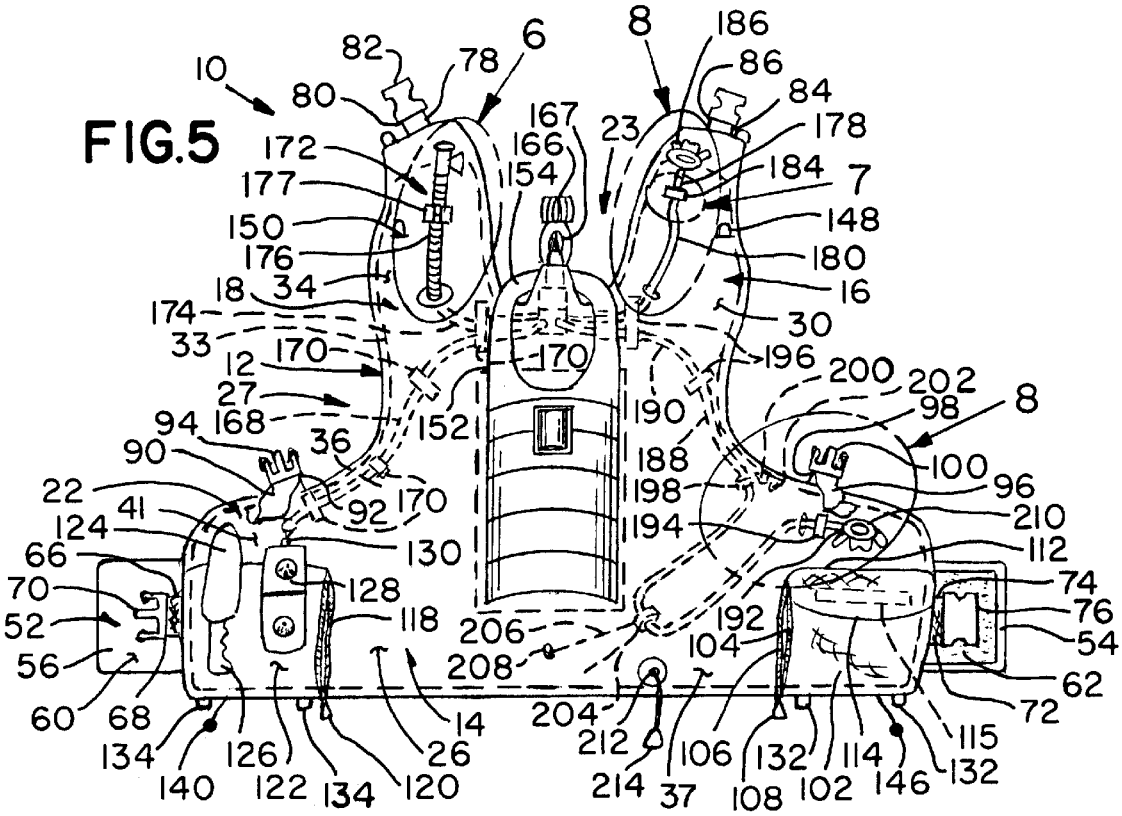
FIG. 5 is a diagrammatic rear elevational view taken generally in the direction of arrow 5 in FIG. 2 of the present invention in the pre-donned configuration.
Figure 8:
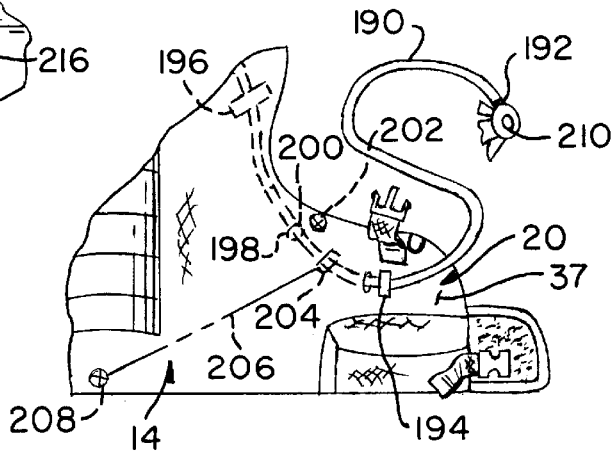
FIG. 8 is an enlarged diagrammatic perspective view of the area generally enclosed by the dotted curve identified by arrow 8 in FIG. 5 of the octopus assembly of the present invention.

The specific configuration of the octopus second stage regulator assembly 188 can best be seen in FIGS. 5 and 8, and as such, will be discussed with reference thereto.

The octopus second stage regulator assembly 188 comprises an octopus low pressure regulator hose 190 that is retractable into, and extendable from, the torso-engaging member 12, as opposed to being manually coiled up and stuffed in, and removed from, a pocket, and fluidly communicates with the first stage regulator 166, and extends sidewardly outwardly downwardly therefrom in the back-engaging portion 14 and then in the right abdomen-engaging portion 20 when retracted so as to be hidden within the torso-engaging member 12, and as a result thereof, is protected from wear and tear from, and snagging on, objects on both land and underwater and provides less resistance during a dive, but substantially straight when extended through the ambient-facing surface 37 of, and along and selectively extending past, the right abdomen-engaging portion 20, to a distal end 192.

The octopus low pressure regulator hose 190 is selectively maintained against the ambient-facing surface 37 of the right abdomen-engaging portion 20 by an octopus regulator hose clasp 194 for requiring only one hand (not shown) of diver (not shown) to release and engage, extends from the ambient-facing surface 37 of the right abdomen-engaging portion 20, and prevents the octopus low pressure regulator hose 190 from dangling obtrusively and becoming damaged when not in use during a dive while maintaining the octopus low pressure regulator hose 190 at a desired extended length when in use during a dive.

An uppermost portion of the octopus low pressure regulator hose 190 is maintained fixedly in the back-engaging portion 14 by a pair of hose retaining straps 196 that are disposed therein.

An uppermost one of the pair of hose retaining straps 196 also fixedly maintains the low pressure regulator hose 180 in the back-engaging portion 14.

The octopus second stage regulator assembly 188 further comprises an upper slide collar 198 that slidably receives the octopus low pressure regulator hose 190.

The octopus second stage regulator assembly 188 further comprises an upper elastic cord 200 that extends sidewardly outwardly from the upper slide collar 198 thereof.

The octopus second stage regulator assembly 188 further comprises an upper anchor point 202 that anchors the upper elastic cord 200 in the right abdomen-engaging portion 20 so as to biasingly retract the octopus low pressure regulator hose 190 into the right abdomen-engaging portion 20 when not in use so as to prevent the octopus low pressure regulator hose 190 from dangling obtrusively and becoming damaged when not in use during a dive.

The octopus second stage regulator assembly 188 further comprises a lower slide collar 204 that slidably receives the octopus low pressure regulator hose 190.

The octopus second stage regulator assembly 188 further comprises a lower elastic cord 206 that extends sidewardly inwardly from the lower slide collar 204 thereof.

The octopus second stage regulator assembly 188 further comprises a lower anchor point 208 that anchors the lower elastic cord 206 in the back-engaging portion 14, below the scuba tank carrier plate 152, so as to further biasingly retract the octopus low pressure regulator hose 190 into the right abdomen-engaging portion 20 when not in use so as to further prevent the octopus low pressure regulator hose 190 from dangling obtrusively and becoming damaged when not in use during a dive.

The octopus second stage regulator assembly 188 further comprises an octopus second stage regulator 210 that fluidly communicates with the distal end 192 of the octopus low pressure regulator hose 190 thereof.

The dive vest 10 further comprises an air release valve 212 that fluidly communicates with the selectively inflatable air bladder 36, and is disposed on the ambient-facing surface 26 of the back-engaging portion 14, below the scuba tank carrier plate 152.

The dive vest 10 further comprises a release valve pull cord 214 that operatively depends from the air release valve 212.

Figure 6:
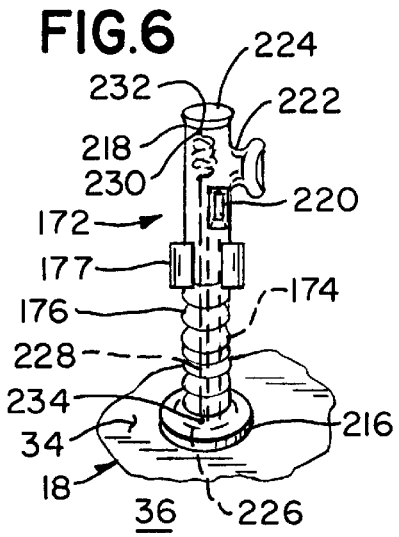
FIG. 6 is an enlarged diagrammatic perspective view of the area generally enclosed by the dotted curve identified by arrow 6 in FIG. 5 of the on-demand/oral inflation hose of the present invention.

The specific configuration of the on demand/oral inflation assembly 172 can best be seen in FIG. 6, and as such, will be discussed with reference thereto.

The external low pressure inflation hose 176 of the on demand/oral inflation assembly 172 is ribbed, flexible, and has a proximal end 216 that is widened, disposed on the ambient-facing surface 34 of the left shoulder-engaging portion 18, and fluidly communicates with the selectively-inflatable air bladder 36, and a distal end 218.

The on demand/oral inflation assembly 172 further comprises an air release valve 226 that is disposed in the proximal end 216 of the external low pressure inflation hose 176 thereof, and selectively fluidly communicates the external low pressure inflation hose 176 with the selectively-inflatable air bladder 36.

The on demand/oral inflation assembly 172 further comprises an auto inflate button 220 that is operatively connected on the external low pressure inflation hose 176 thereof, between the distal end 218 of the external low pressure inflation hose 176 thereof and the hose snaps 177 thereof, and when pushed, fluidly communicates the internal low pressure inflation hose 174 with the external low pressure inflation hose 176 for allowing air from the scuba tank (not shown) to automatically open the air release valve 226 and inflate the selectively-inflatable air bladder 36.

The on demand/oral inflation assembly 172 further comprises a mouthpiece 222 that extends sidewardly from, and fluidly communicates with, the external low pressure inflation hose 176 thereof, and is disposed between the distal end 218 of the external low pressure inflation hose 176 thereof and the auto inflate button 220 thereof.

The on demand/oral inflation assembly 172 further comprises a spring loaded oral inflate button 224 that is operatively connected to the distal end 218 of the external low pressure inflation hose 176 thereof, and normally biases the air release valve 226 closed, and when pushed, causes the air release valve 226 to open and fluidly communicate the external low pressure inflation hose 176 with the selectively-inflatable air bladder 36, so as to allow the selectively-inflatable air bladder 36 to be manually inflated when the mouthpiece 222 thereof is blown into.

The on demand/oral inflation assembly 172 further comprises a pull cable 228 that extends axially in the external low pressure inflation hose 176 thereof, and has an upper terminal end 230 that is anchored, by an anchor point 232, to the spring loaded oral inflate button 224, and a lower terminal end 234 that is connected to the air release valve 226 thereof, and when the spring loaded oral inflate button 224 is pushed, the pull cable 228 slacks and allows the air release valve 226 thereof to open and fluidly communicate the external low pressure inflation hose 176 with the selectively-inflatable air bladder 36.

Figure 7:
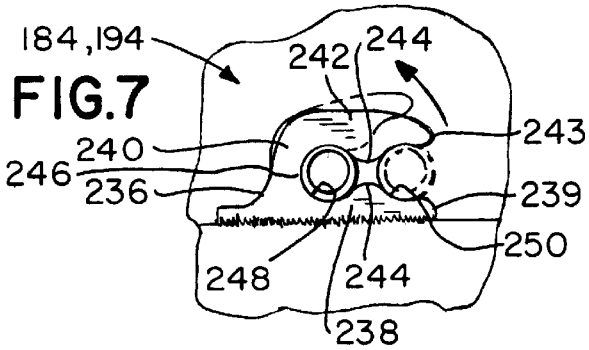
FIG. 7 is an enlarged diagrammatic perspective view of the area generally enclosed by the dotted curve identified by arrow 7 in FIG. 5 of the clasp of the present invention.

The specific configuration of the regulator hose clasp 184 and the octopus regulator hose clasp 194 can best be seen in FIG. 7, and as such, will be discussed with reference thereto.

Each of the regulator hose clasp 184 and the octopus regulator hose clasp 194 has a body 236 that is generally C-shaped, and has a base 238 with a free end 239, a spine 240 that extends upwardly from the base 238 of the body 236, and a head 242 that extends resiliently from the spine 240 of the body 236 to a free end 243, and is disposed over, spaced from, and substantially parallel to, the base 238 of the body 236.

The base 238 of the body 236 and the head 242 of the body 236 have inner facing surfaces 244 joined by an inner surface 246 of the spine 240 of the body 236.

The inner surface 246 of the spine 240 of the body 236 together with innermost portions of the inner surfaces 244 of the base 238 of the body 236 and the head 242 of the body 236 define a first opening 248 that is circular-shaped and snapingly captures therein an associated one of the low pressure regulator hose 180 and the octopus low pressure regulator hose 190 if a secure capture is required.

Outermost portions of the inner surfaces 244 of the base 238 of the body 236 and the head 242 of the body 236 define a second opening 250 that is circular-shaped, aligningly spaced from the first opening 248, and snapingly captures therein the associated one of the low pressure regulator hose 180 and the octopus low pressure regulator hose 190, and is for communicating with the ambient so as to provide a weaker capture than that of the first opening 248 if a not so secure capture is required, such as one that is only temporary.

It will be understood that each of the elements described above, or two or more together, may also find a useful application in other types of constructions differing from the types described above.

While the invention has been illustrated and described as embodied in a dive vest, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A dive vest, comprising a torso-engaging member comprising:

a) a back-engaging portion;

b) a right shoulder-engaging portion extending upwardly and outwardly from said back-engaging portion prior to donning said dive vests and forwardly then downwardly after donning said dive vest;

c) a left shoulder-engaging portion extending upwardly and outwardly from said back-engaging portion prior to donning said dive vest and forwardly then downwardly after donning said dive vest;

d) a right abdomen-engaging portion extending sidewardly and outwardly from said back-engaging portion prior to donning said dive vest and forwardly then inwardly after donning said dive vest; and e) a left abdomen-engaging portion extending sidewardly from said back-engaging portion prior to donning said dive vest and forwardly then inwardly after donning said dive vest, wherein said right shoulder-engaging portion and said left shoulder-engaging portion define therebetween a neck-receiving space when said dive vest is donned, wherein said right shoulder-engaging portion and said right abdomen-engaging portion define therebetween a right arm-receiving space when said dive vest is donned, wherein said left shoulder-engaging portion and said left abdomen-engaging portion define therebetween a left arm-receiving space when said dive vest is donned, wherein said back-engaging portion has:

f) a back-facing surface; and g) an ambient-facing surface that is opposite to said back-facing surface thereof, wherein said right shoulder-engaging portion has:

h) a shoulder-facing surface that is continuous with said back-facing surface of said back-engaging portion; and i) an ambient-facing surface that is opposite to said shoulder-facing surface thereof and is continuous with said ambient-facing surface of said back-engaging portion, wherein said left shoulder-engaging portion has:

j) a shoulder-facing surface that is continuous with said back-facing surface of said back-engaging portion; and k) an ambient-facing surface that is opposite to said shoulder-facing surface thereof and is continuous with said ambient-facing surface of said back-engaging portion, wherein said right abdomen-engaging portion has:

l) an abdomen-facing surface that is continuous with said back-facing surface of said back-engaging portion; and m) an ambient-facing surface that is opposite to said abdomen-facing surface thereof and is continuous with said ambient-facing surface of said back-engaging portion, wherein said left abdomen-engaging portion has:

n) an abdomen-facing surface that is continuous with said back-facing surface of said back-engaging portion; and o) an ambient-facing surface that is opposite to said abdomen-facing surface thereof and is continuous with said ambient-facing surface of said back-engaging portion, wherein said torso-engaging member further comprises a selectively-inflatable air bladder that is contained in, and extends throughout, said back-engaging portion thereof, said right shoulder-engaging portion thereof, said left shoulder-engaging portion thereof, said right abdomen-engaging portion thereof, and said left abdomen-engaging portion thereof, so as to provide full flotation, and not just back mounted flotation, and when inflated, renders said torso-engaging member buoyant, wherein said right shoulder-engaging portion further has right shoulder padding that extends along a majority of said shoulder-facing surface thereof for providing comfort for the right shoulder of a diver when said dive vest is donned, wherein said left shoulder-engaging portion further has left shoulder padding that extends along a majority of said surface thereof for providing comfort for the left shoulder of a diver when said dive vest is donned, wherein said back-engaging portion further has back padding that extends along a majority of said back-facing surface thereof for providing comfort for the back of a diver when said dive vest is donned, wherein said right abdomen-engaging portion further has a right waist band-retaining band that extends vertically across an intermediate portion of said abdomen-facing surface thereof, wherein said left abdomen-engaging portion further has a left waist band-retaining band that extends vertically across an intermediate portion of said abdomen-facing surface thereof, and is in alignment with said right waist band-retaining band, wherein said back-engaging portion further has a first intermediate waist band-retaining band that extends vertically across a lower portion of said back-facing surface thereof, intermediate said back padding and, and in alignment with, said right waist band-retaining band, wherein said back-engaging portion further has a second intermediate waist band-retaining band that extends vertically across a lower portion of said back-facing surface thereof, intermediate said back padding and, and in alignment with, said left waist band-retaining band, wherein said torso-engaging member further comprises an adjustable waist band that is slender, elongated, and extends under, and is retained by, said right waist band-retaining band, said first intermediate waist band-retaining band, said back padding, said second intermediate waist band-retaining band, and said left waist band-retaining band, wherein said adjustable waist band has:

p) a right terminal end that extends outwardly past said right abdomen-engaging portion;

q) a left terminal end that extends past said left abdomen-engaging portion;

r) a torso-facing surface; and s) an ambient-facing surface, wherein said adjustable waist band further has a waist band patch of hook portions of hook and loop fasteners that is disposed at said right terminal end thereof, on said ambient-facing surface thereof, wherein said adjustable waist band further has a waist band patch of loop portions of hook and loop fasteners that is disposed at said left terminal end thereof, on said torso-facing surface thereof, and selectively engages with said waist band patch of hook portions of hook and loop fasteners, wherein said torso-engaging member further comprises a left waist adjustment strap that extends slightly sidewardly from said left abdomen-engaging portion, to a terminal end, wherein said torso-engaging member further comprises a left waist male portion of a quick disconnect buckle that extends axially from said terminal end of said left waist adjustment strap, and overlies a minority of said left terminal end of said adjustable waist band, on, so as to be cushioned by, said ambient-facing surface thereof for providing comfort for the waist of a diver when said dive vest is donned, wherein said torso-engaging member further comprises a right waist adjustment strap that extends slightly sidewardly from said right abdomen-engaging portion, to a terminal end, wherein said torso-engaging member further comprises a right waist female portion of a quick disconnect buckle that selectively engages with said left waist male portion of a quick disconnect buckle, and extends axially from said terminal end of said right waist adjustment strap, and overlies a minority of said right terminal end of said adjustable waist band, on, so as to be cushioned by, said ambient-facing surface thereof for providing comfort for the waist of a diver when said dive vest is donned, wherein said torso-engaging member further comprises a left shoulder adjustment strap that extends slightly upwardly from said left shoulder-engaging portion, to a terminal end, wherein said torso-engaging member further comprises a left shoulder female portion of a quick disconnect buckle that extends axially from said terminal end of said left shoulder adjustment strap, wherein said torso-engaging member further comprises a right shoulder adjustment strap that extends slightly upwardly from said right shoulder-engaging portion, to a terminal end, wherein said torso-engaging member further comprises a right shoulder male portion of a quick disconnect buckle that extends axially from said terminal end of said right shoulder adjustment strap, wherein said torso-engaging member further comprises a left abdomen adjustment strap that extends slightly upwardly from said left abdomen-engaging portion, to a terminal end, wherein said torso-engaging member further comprises a left abdomen male portion of a quick disconnect buckle that extends axially from said terminal end of said left abdomen adjustment strap, and selectively engages with said left shoulder female portion of a quick disconnect buckle, and when engaged therewith, forms said left arm-receiving space, wherein said torso-engaging member further comprises a right abdomen adjustment strap that extends slightly upwardly from said right abdomen-engaging portion, to a terminal end, wherein said torso-engaging member further comprises a right abdomen male portion of a quick disconnect buckle that extends axially from said terminal end of said right abdomen adjustment strap, and selectively engages with said right shoulder female portion of a quick disconnect buckle, and when engaged therewith, forms said right arm-receiving space, wherein said torso-engaging member further comprises a two-way right abdomen pocket that is disposed on a forwardmost portion of said ambient-facing surface of said right abdomen-engaging portion, wherein said two-way right abdomen pocket comprises a first pocket that is accessible through a right side opening that is selectively closed by a right zipper, wherein said two-way right abdomen pocket further comprises a second pocket that overlies said first pocket and is accessible through a right top opening that is selectively closed by a flap which is selectively maintained closed by mating portions of flap hook and loop fasteners, wherein said torso-engaging member further comprises a left abdomen pocket that is disposed on a forwardmost portion of said ambient-facing surface of said left abdomen-engaging portion, and is accessible through a left side opening that is selectively closed by a left zipper, and has an ambient-facing surface; further comprising a dive knife sheath attached to said ambient-facing surface of said left abdomen pocket, and opening downwardly; further comprising a dive knife that is replaceably disposed in said dive knife sheath; further comprising a gauge console swively attached, by a swivel joint, to said ambient-facing surface of said left abdomen-engaging portion, and depends therefrom to over said ambient-facing surface of said left abdomen pocket, between said dive knife sheath and said left zipper, as opposed to being stuffed into a zippered pocket making critical access difficult.

2. The vest as defined in claim 1; further comprising a pair of right abdomen utility D-rings depending spacingly from a forwardmost portion of said right abdomen-engaging portion, directly below said two-way right abdomen pocket.

3. The vest as defined in claim 2; further comprising a pair of left abdomen utility D-rings depending spacingly from a forwardmost portion of said left abdomen-engaging portion, directly below said left abdomen pocket.

4. The vest as defined in claim 3; further comprising a left beaded weight pad disposed in a left waist band compartment contained in said adjustable waist band, and disposed between said second intermediate waist band-retaining band and said left waist band-retaining band.

5. The vest as defined in claim 4, wherein said left beaded weight pad is quick releasable from said left waist band compartment by a left quick release pull cord that operatively depends from said left waist band compartment.

6. The vest as defined in claim 5; further comprising a right beaded weight pad disposed in a right waist band compartment contained in said adjustable waist band, and disposed between said right waist band-retaining band and said first intermediate waist band-retaining band.

7. The vest as defined in claim 6, wherein said right beaded weight pad is quick releasable from said right waist band compartment by a right quick release pull cord 146 that operatively depends from said right waist band compartment.

8. The vest as defined in claim 6; further comprising a right shoulder utility D-ring disposed on a forwardmost portion of said ambient-facing surface of said right shoulder-engaging portion, slightly inwardly of said right arm-receiving space.

9. The vest as defined in claim 8; further comprising a left shoulder utility D-ring disposed on a forwardmost portion of said ambient-facing surface of said left shoulder-engaging portion, slightly inwardly of said left arm-receiving space.

10. The vest as defined in claim 9; further comprising a scuba tank carrier plate extending vertically along said ambient-facing surface of said back-engaging portion, and into said neck-receiving space, where it is formed into a carry handle.

11. The vest as defined in claim 10, wherein said scuba tank carrier plate is made of molded hard plastic that is shaped for holding the scuba tank.

12. The vest as defined in claim 11; further comprising a first tank holding strap being slender, elongated, extending sideways outwardly from one side of said scuba tank carrier plate, along an intermediate point therealong, and having an ambient-facing surface.

13. The vest as defined in claim 12; further comprising a second tank holding strap being slender, elongated, and extending sideways outwardly from the other side of said scuba tank carrier plate, along an intermediate point therealong, to a terminal end.

14. The vest as defined in claim 13; further comprising a tank holding clasp extending axially from said terminal end of said second tank holding strap, and selectively engaging said first tank holding strap, and when engaged therewith, capturing and holding the scuba tank against said scuba tank carrier plate.

15. The vest as defined in claim 14; further comprising mating portions of tank strap hook and loop fasteners spaced along said ambient-facing surface of said first tank holding strap, and when said first tank holding strap engages said tank holding clasp and captures and holds the scuba tank against said scuba tank carrier plate, said first tank holding strap is doubled back onto itself and maintained thereat by engagement of said mating portions of tank strap hook and loop fasteners with each other so as to prevent said first tank holding strap from dangling obtrusively and becoming damaged during a dive.

16. The vest as defined in claim 15; further comprising a first stage regulator permanently attached hereto, being supported by said scuba tank carrier plate, being disposed in proximity of said carry handle, and being for fluidly communicating with the scuba tank.

17. The vest as defined in claim 16, wherein said first stage regulator has a base that is extended and flexible for facilitating attachment to the valve of the scuba tank.

18. The vest as defined in claim 17; further comprising an internal low pressure gauge hose fluidly communicating said first stage regulator with said gauge console.

19. The vest as defined in claim 18, wherein said internal low pressure gauge hose depends from said first stage regulator, through said ambient-facing surface of, and into, said back-engaging portion and then through said left abdomen-engaging portion so as to be permanently hidden within said torso-engaging member, and as a result thereof, it is protected from wear and tear from, and snagging on, objects on both land and underwater and it provides less resistance during a dive, as opposed to having to be manually stuffed into, and removed from, a pocket, and then out said ambient-facing surface of said left abdomen-engaging portion, at, and to, said gauge console.

20. The vest as defined in claim 19, wherein said internal low pressure gauge hose is maintained in said back-engaging portion and said left abdomen-engaging portion by a plurality of gauge hose retaining straps that are disposed therein.

21. The vest as defined in claim 20; further comprising an on demand/oral inflation assembly fluidly communicating with said first stage regulator, and extending upwardly therefrom in said back-engaging portion and said left shoulder-engaging portion, and out through said ambient-facing surface of said left shoulder-engaging portion, as opposed to having to be manually stuffed into, and removed from, a pocket.

22. The vest as defined in claim 21, wherein said on demand/oral inflation assembly comprises an internal low pressure inflation hose that fluidly communicates with said first stage regulator, selectively fluidly communicates with said selectively-inflatable air bladder, and extends sidewardly outwardly upwardly from said first stage regulator, in said back-engaging portion and then upwardly in said left shoulder-engaging portion, to, and through, said ambient-facing surface of said left shoulder-engaging portion.

23. The vest as defined in claim 22, wherein said internal low pressure inflation hose is maintained in said back-engaging portion and said left shoulder-engaging portion by sharing an uppermost strap of said plurality of gauge hose retaining straps.

24. The vest as defined in claim 23, wherein said on demand/oral inflation assembly further comprises an external low pressure inflation hose that fluidly communicates with said selectively-inflatable air bladder, selectively fluidly communicates with said internal low pressure inflation hose that extends axially therein, and extends outwardly from said ambient-facing surface of, and extends along, but not past so as to be protected by when not in use, said left shoulder-engaging portion.

25. The vest as defined in claim 24, wherein said external low pressure inflation hose is selectively maintained against said ambient-facing surface of said left shoulder-engaging portion by hose snaps so as to prevent said external low pressure inflation hose from dangling obtrusively and becoming damaged when not in use during a dive.

26. The vest as defined in claim 25; further comprising a second stage regulator assembly fluidly communicating with said first stage regulator.

27. The vest as defined in claim 26, wherein said second stage regulator assembly comprises a low pressure regulator hose that fluidly communicates with said first stage regulator, and extends sidewardly outwardly upwardly therefrom in said back-engaging portion and then upwardly in said right shoulder-engaging portion, through said ambient-facing surface of, and along, but not past so as to be protected by when not in use, said right shoulder-engaging portion, to a distal end for exiting said right shoulder-engaging portion as close as possible to the mouth of a diver, as opposed to exiting and extending upwardly along the torso of the diver and becoming damaged from wear and tear from, and snagging on, objects on both land and underwater while-also providing resistance during a dive.

28. The vest as defined in claim 27, wherein said low pressure regulator hose is selectively maintained against said ambient-facing surface of said right shoulder-engaging portion by a regulator hose clasp for requiring only one hand of diver to release and engage, extends from said ambient-facing surface of said right shoulder-engaging portion, and prevents the low pressure regulator hose from dangling obtrusively and becoming damaged when not in use during a dive.

29. The vest as defined in claim 28, wherein said regulator hose clasp is molded from hard plastic.

30. The vest as defined in claim 29, wherein said second stage regulator assembly further comprises a second stage regulator that fluidly communicates with said distal end of said low pressure regulator hose thereof.

31. The vest as defined in claim 30; further comprising an octopus second stage regulator assembly fluidly communicating with said first regulator.

32. The vest as defined in claim 31, wherein said octopus second stage regulator assembly comprises an octopus low pressure regulator hose that is retractable into, and extendable from said torso-engaging member, as opposed to being manually coiled up and stuffed in, and removed from, a pocket, and fluidly communicates with said first stage regulator, and extends sidewardly outwardly downwardly therefrom in said back-engaging portion and then serpintiningly in said right abdomen-engaging portion when retracted so as to be hidden in said torso-engaging member, and as a result thereof, it is protected from wear and tear from, and snagging on, objects on both land and underwater and it provides less resistance during a dive, but substantially. straight when extended, through said ambient-facing surface of, and along and selectively extending past, said right abdomen-engaging portion, to a distal end.

33. The vest as defined in claim 32, wherein said octopus low pressure regulator hose is selectively maintained against said ambient-facing surface of said right abdomen-engaging portion by an octopus regulator hose clasp for requiring only one hand of a diver to release and engage, that extends from said ambient-facing surface of said right abdomen-engaging portion, and prevents said octopus low pressure regulator hose from dangling obtrusively and becoming damaged when not in use during a dive while maintaining said octopus low pressure regulator hose at a desired extended length when in use during a dive.

34. The vest as defined in claim 33, wherein an uppermost portion of said octopus low pressure regulator hose is maintained fixedly in said back-engaging portion by a pair of hose retaining straps that are disposed therein.

35. The vest as defined in claim 34, wherein an uppermost one of said pair of hose retaining straps also fixedly maintains said low pressure regulator hose in said back-engaging portion.

36. The vest as defined in claim 35, wherein said octopus second stage regulator assembly further comprises an upper slide collar slidably that receives said octopus low pressure regulator hose.

37. The vest as defined in claim 36, wherein said octopus second stage regulator assembly further comprises an upper elastic cord that extends sidewardly outwardly from said upper slide collar thereof.

38. The vest as defined in claim 37, wherein said octopus second stage regulator assembly further comprises an upper anchor point that anchors said upper elastic cord in said right abdomen-engaging portion so as to biasingly retract said octopus low pressure regulator hose into said right abdomen-engaging portion when not in use so as to prevent said octopus low pressure regulator hose from dangling obtrusively and becoming damaged when not in use during a dive.

39. The vest as defined in claim 38, wherein said octopus second stage regulator assembly further comprises a lower slide collar that slidably receives said octopus low pressure regulator hose.

40. The vest as defined in claim 39, wherein said octopus second stage regulator assembly further comprises a lower elastic cord that extends sidewardly inwardly from said lower slide collar thereof.

41. The vest as defined in claim 40, wherein said octopus second stage regulator assembly further comprises a lower anchor point that anchors said lower elastic cord in said back-engaging portion, below said scuba tank carrier plate, so as to further biasingly retract said octopus low pressure regulator hose into said right abdomen-engaging portion when not in use so as to further prevent said octopus low pressure regulator hose from dangling obtrusively and becoming damaged when not in use during a dive.

42. The vest as defined in claim 41, wherein said octopus second stage regulator assembly further comprises an octopus second stage regulator that fluidly communicates with said distal end of said octopus low pressure regulator hose thereof.

43. The vest as defined in claim 42; further comprising an air release valve fluidly communicating with said selectively inflatable air bladder, and disposed on said ambient-facing surface of said back-engaging portion, below said scuba tank carrier plate.

44. The vest as defined in claim 43; further comprising a release valve pull cord operatively depending from said air release valve.

45. The vest as defined in claim 44, wherein said external low pressure inflation hose of said on demand/oral inflation assembly is ribbed, flexible, and has:

a) a proximal end that is widened, disposed on said ambient-facing surface of said left shoulder-engaging portion, and fluidly communicates with said selectively-inflatable air bladder; and b) a distal end.

46. The vest as defined in claim 45, wherein said on demand/oral inflation assembly further comprises an air release valve that is disposed in said proximal end of said external low pressure inflation hose thereof, and selectively fluidly communicates said external low pressure inflation hose with said selectively-inflatable air bladder.

47. The vest as defined in claim 46, wherein said on demand/oral inflation assembly further comprises an auto inflate button that is operatively connected on said external low pressure inflation hose thereof, between said distal end of said external low pressure inflation hose thereof and said hose snaps thereof, and when pushed, fluidly communicates said internal low pressure inflation hose with said external low pressure inflation hose for allowing air from the scuba tank to automatically open said air release valve and inflate said selectively-inflatable air bladder.

48. The vest as defined in claim 47, wherein said on demand/oral inflation assembly further comprises a mouthpiece that extends sidewardly from, and fluidly communicates with, said external low pressure inflation hose thereof, and is disposed between said distal end of said external low pressure inflation hose thereof and said auto inflate button thereof.

49. The vest as defined in claim 48, wherein said on demand/oral inflation assembly further comprises a spring loaded oral inflate button that is operatively connected to said distal end of said external low pressure inflation hose thereof, and normally biases said air release valve closed, and when pushed, causes said air release valve to open and fluidly communicate said external low pressure inflation hose with said selectively-inflatable air bladder so as to allow said selectively-inflatable air bladder to be manually inflated when said mouthpiece thereof is blown into.

50. The vest as defined in claim 49, wherein said on demand/oral inflation assembly further comprises a pull cable that extends axially in said external low pressure inflation hose thereof, and has:

a) an upper terminal end that is anchored, by an anchor point, to the inner surface of the on demand/oral inflation hose; and b) a lower terminal end that is connected to said air release valve thereof, and when the distal end of the on demand/oral inflation hose assembly is pulled downward and away from the air release valve, excess air can pass through the now open valve to the ambient environment from the selectively inflatable air bladder, relieving over pressure and a potential for air bladder burst.

51. The vest as defined in claim 50, wherein said torso-engaging member further comprises a buffer layer that is contained thereon and captures and protect said selectively-inflatable air bladder.

52. The vest as defined in claim 51, wherein each of said regulator hose clasp and said octopus regulator hose clasp has a body that is generally C-shaped, and has:

a) a base with a free end;

b) a spine that extends upwardly from said base of said body; and c) a head that extends resiliently from said spine of said body to a free end, and is disposed over, spaced from, and substantially parallel to, said base of said body.

53. The vest as defined in claim 52, wherein said base of said body and said head of said body have inner facing surfaces joined by an inner surface of said spine of said body.

54. The vest as defined in claim 53, wherein said inner surface of said spine of said body together with innermost portions of said inner surfaces of said base of said body and said head of said body define a first opening that is circular-shaped and snapingly captures therein an associated one of said low pressure regulator hose and said octopus low pressure regulator hose, if a secure capture is required.

55. The vest as defined in claim 54, wherein outermost portions of said inner surfaces of said base of said body and said head of said body define a second opening that is circular-shaped, aligningly spaced from said first opening, and snapingly and captures therein said associated one of said low pressure regulator hose and said octopus low pressure regulator hose, and is for communicating with the ambient so as to provide a weaker capture than that of said first opening, if a not so secure capture is required, such as one that is only temporary.

* * * * *